US008572782B1

(12) United States Patent
Amini

(10) Patent No.: US 8,572,782 B1
(45) Date of Patent: Nov. 5, 2013

(54) INFANT POSITIONING KIT ASSEMBLY

(76) Inventor: Kamyar Amini, Sherman Oaks, CA (US)

( * ) Notice: Subject to any disclaimer, the term of this patent is extended or adjusted under 35 U.S.C. 154(b) by 0 days.

(21) Appl. No.: 13/314,701

(22) Filed: Dec. 8, 2011

(51) Int. Cl.

| | |
|---|---|
| ***B68G 5/00*** | (2006.01) |
| ***A47G 9/00*** | (2006.01) |
| ***A47G 9/02*** | (2006.01) |
| ***A47B 7/02*** | (2006.01) |
| ***A47C 31/00*** | (2006.01) |
| ***A47C 17/00*** | (2006.01) |

(52) U.S. Cl.
USPC ..... 5/655; 5/485; 5/494; 5/603; 5/617; 5/660; 5/737; 5/738

(58) Field of Classification Search
USPC ..... 5/655, 738, 485, 603, 660, 737, 494, 5/617; 2/69.5
See application file for complete search history.

(56) References Cited

U.S. PATENT DOCUMENTS

| | | | | |
|---|---|---|---|---|
| 1,382,531 | A * | 6/1921 | Newborn | 5/706 |
| 2,374,712 | A * | 5/1945 | Steigerwald | 128/872 |
| 2,404,505 | A | 7/1946 | Knecht | |
| 2,851,703 | A * | 9/1958 | Greco | 5/496 |
| 3,389,411 | A * | 6/1968 | Emery | 5/490 |
| 4,202,052 | A * | 5/1980 | Bilanzich | 2/69.5 |
| D281,833 | S | 12/1985 | Carney | |
| 4,627,123 | A * | 12/1986 | Uggerud | 5/485 |
| 4,651,370 | A * | 3/1987 | Vitale | 5/407 |
| 4,862,535 | A | 9/1989 | Roberts | |
| 4,911,105 | A | 3/1990 | Hocum | |
| 4,989,286 | A * | 2/1991 | Tucker | 5/482 |
| 5,014,376 | A * | 5/1991 | Doran et al. | 5/603 |
| 5,329,934 | A * | 7/1994 | Bowman | 5/603 |
| 5,416,938 | A * | 5/1995 | Li | 5/494 |
| 5,439,008 | A | 8/1995 | Bowman | |
| 5,566,411 | A * | 10/1996 | Eiler | 5/494 |
| 5,746,219 | A * | 5/1998 | McConnell | 128/845 |
| 5,996,147 | A * | 12/1999 | Trimble | 5/482 |
| 6,708,356 | B1 | 3/2004 | LaValle | |
| 6,931,683 | B1 | 8/2005 | Elkin et al. | |
| 7,111,344 | B2 * | 9/2006 | French | 5/494 |
| 7,251,846 | B1 | 8/2007 | Elkin et al. | |
| 7,415,743 | B2 * | 8/2008 | Rubio | 5/722 |
| 7,673,354 | B2 * | 3/2010 | Fader | 5/494 |
| 7,681,266 | B2 * | 3/2010 | Gerlach | 5/655 |
| 7,757,320 | B2 * | 7/2010 | Lord et al. | 5/655 |
| 7,856,689 | B2 * | 12/2010 | Habimana | 5/655 |
| 8,020,226 | B2 * | 9/2011 | Landry | 5/494 |
| 8,032,961 | B1 * | 10/2011 | Downs | 5/655 |
| 8,302,230 | B1 * | 11/2012 | Jarrett et al. | 5/655 |
| 2005/0114998 | A1 * | 6/2005 | Leventhal et al. | 5/615 |
| 2008/0029103 | A1 * | 2/2008 | Regev et al. | 128/875 |
| 2008/0172794 | A1 | 7/2008 | Lord | |
| 2008/0184486 | A1 * | 8/2008 | Byrne et al. | 5/494 |
| 2009/0113630 | A1 * | 5/2009 | Landry | 5/494 |
| 2010/0154122 | A1 * | 6/2010 | Crispino et al. | 5/636 |
| 2011/0277210 | A1 * | 11/2011 | Hardesty | 2/69.5 |

* cited by examiner

*Primary Examiner* — William Kelleher
*Assistant Examiner* — Eric Kurilla

(57) ABSTRACT

A infant positioning kit assembly for positioning an infant in a supine position while in a crib includes a mattress cover that has a top wall, a bottom wall and a perimeter wall that is attached to and extends between the top and bottom walls. The bottom wall has a mattress aperture extending therethrough for inserting a mattress into the mattress cover. An elastic band is attached to and is coextensive with a perimeter edge of the aperture and a first mating member is attached to the top wall. An attachment member is configured to be worn by an infant and a second mating member is attached to the attachment member. The second mating member is releasably attachable to the first mating member to retain an infant in a selected position on the mattress cover. The first and second mating members comprise hook and loop couplers.

3 Claims, 4 Drawing Sheets

INFANT POSITIONING KIT ASSEMBLY

BACKGROUND OF THE DISCLOSURE

Field of the Disclosure

The disclosure relates to infant positioning devices and more particularly pertains to a new infant positioning device for positioning an infant in a supine position while in a crib.

SUMMARY OF THE DISCLOSURE

An embodiment of the disclosure meets the needs presented above by generally comprising a mattress cover that has a top wall, a bottom wall and a perimeter wall that is attached to and extends between the top and bottom walls. The perimeter wall includes a front wall, a back wall, a first lateral wall and a second lateral wall. The bottom wall has a mattress aperture extending therethrough for inserting a mattress into the mattress cover. An elastic band is attached to and is coextensive with a perimeter edge of the aperture and a first mating member is attached to the top wall. An attachment member is configured to be worn by an infant and a second mating member is attached to the attachment member. The second mating member is releasably attachable to the first mating member to retain an infant in a selected position on the mattress cover. The first and second mating members comprise hook and loop couplers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
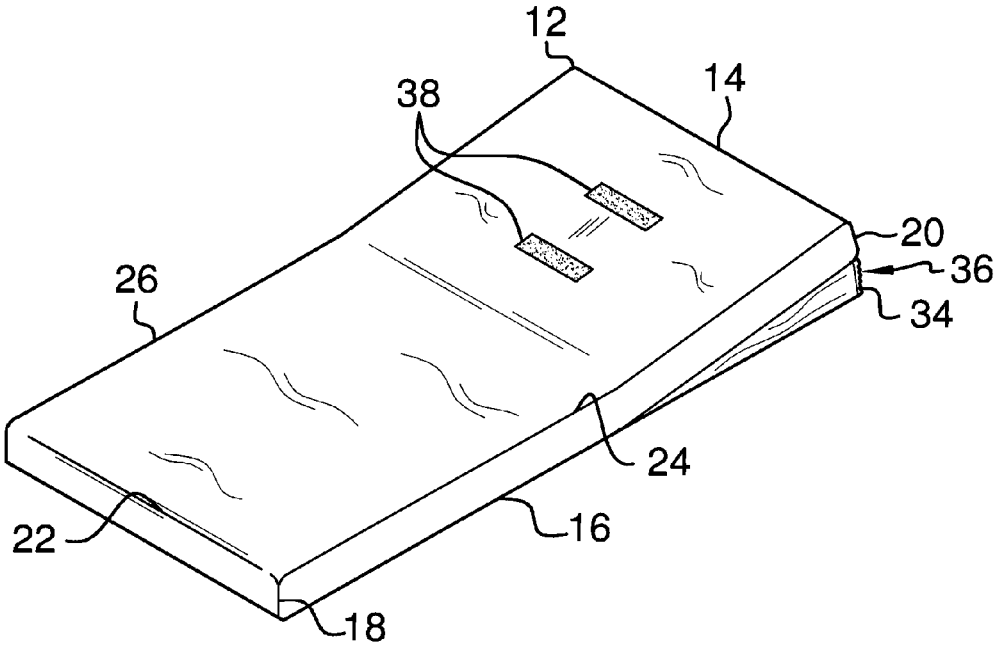
FIG. 1 is a top perspective view of an infant positioning kit assembly according to an embodiment of the disclosure.
Figure 2:
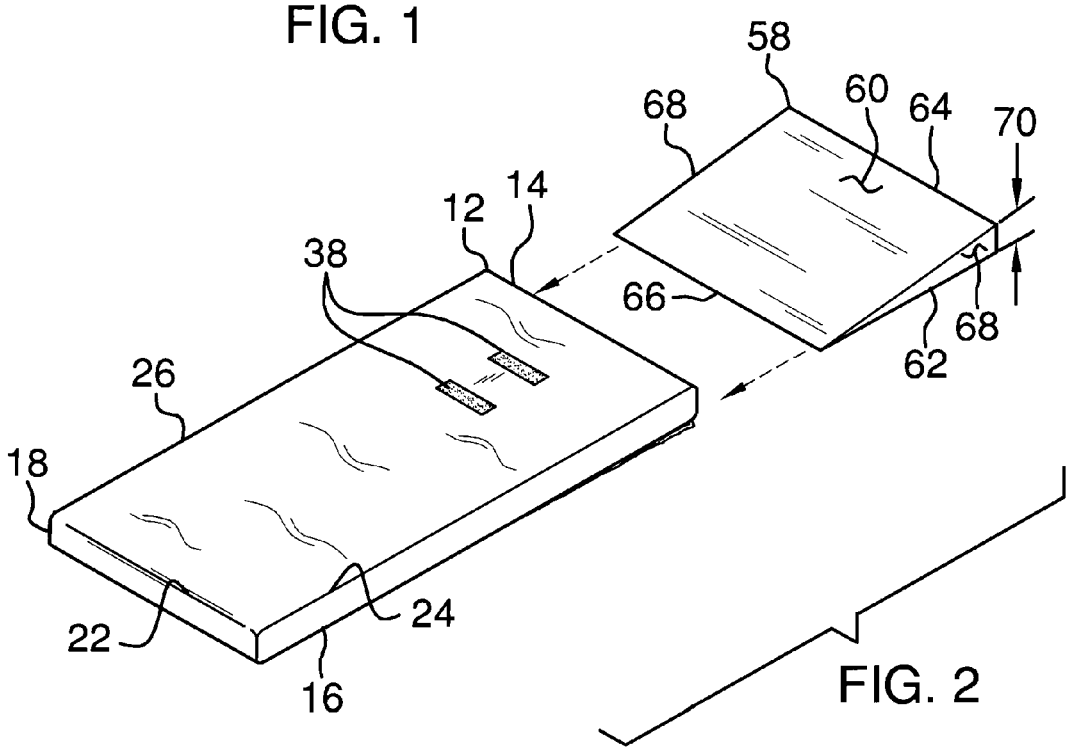
FIG. 2 is a top perspective exploded view of an embodiment of the disclosure.
Figure 3:
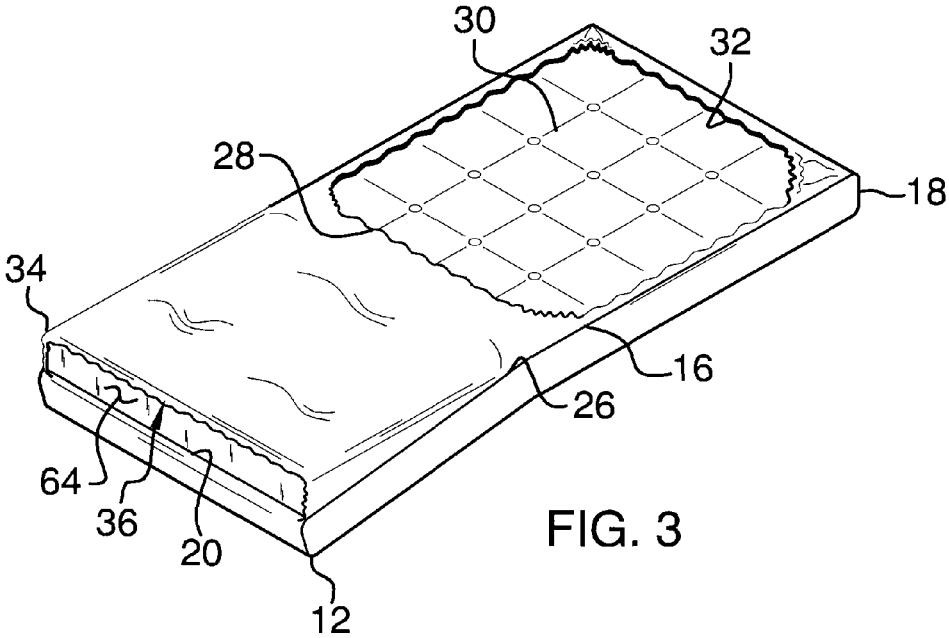
FIG. 3 is a bottom perspective view of an embodiment of the disclosure.
Figure 4:
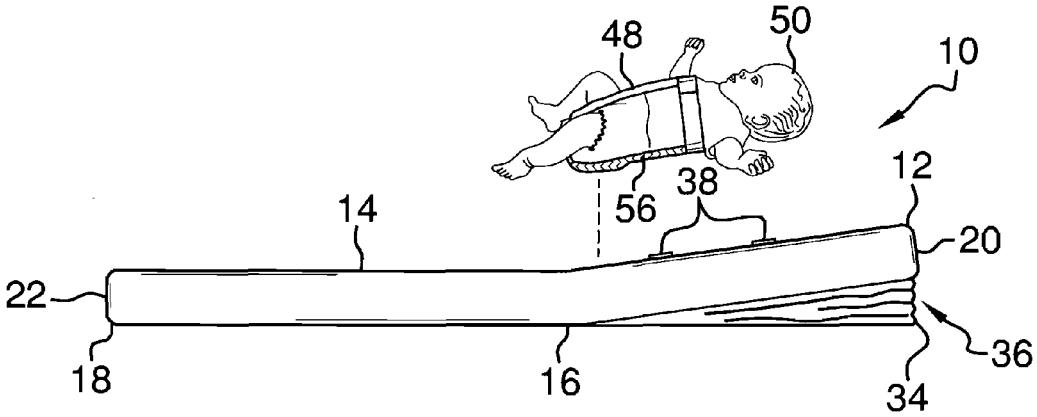
FIG. 4 is a right side exploded view of an embodiment of the disclosure.
Figure 5:
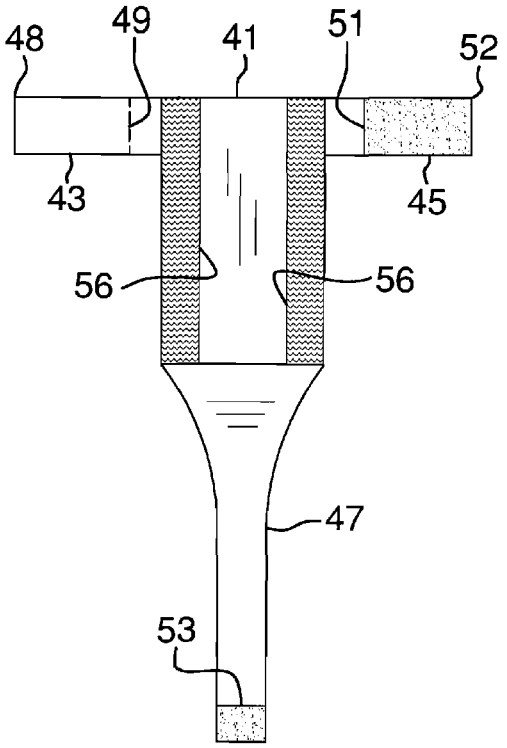
FIG. 5 is a bottom view of an embodiment of the disclosure.
Figure 6:
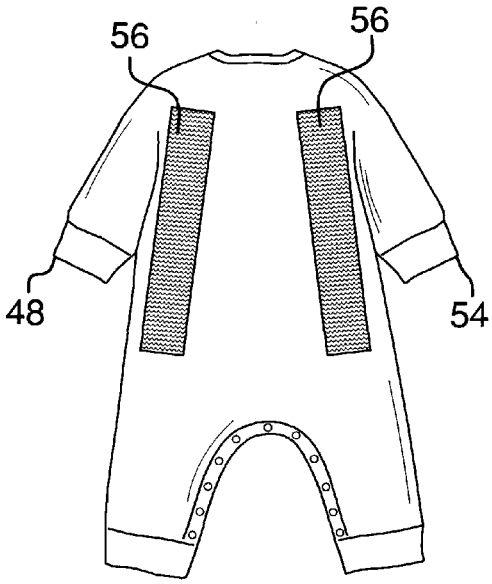
FIG. 6 is a bottom view of an embodiment of the disclosure.
Figure 7:
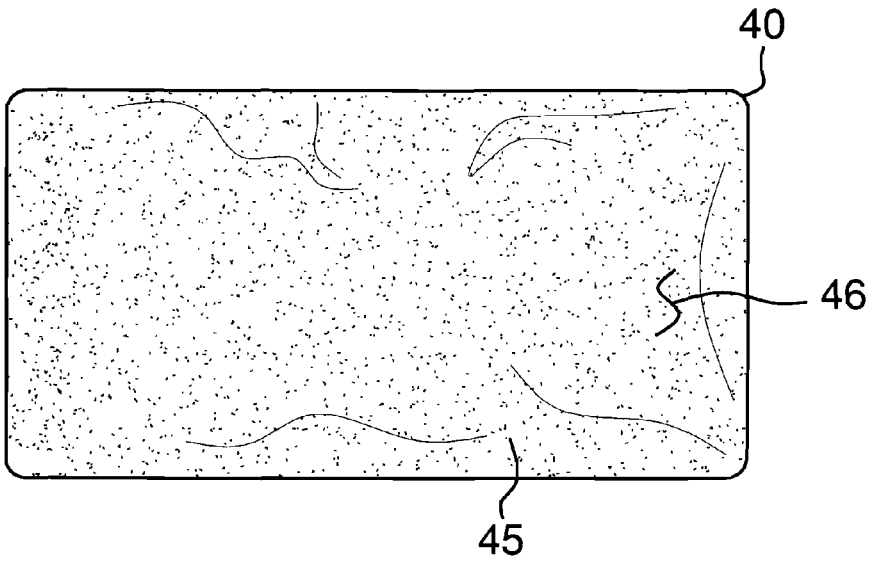
FIG. 7 is a top view of an embodiment of the disclosure.
Figure 8:
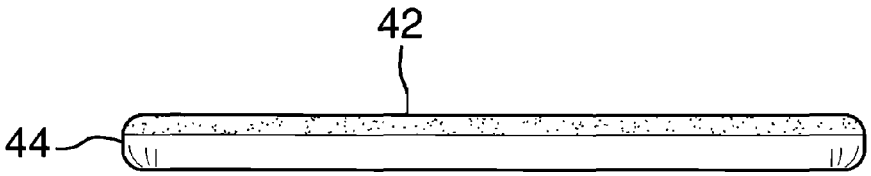
FIG. 8 is a left side view of an embodiment of the disclosure.

With reference now to the drawings, and in particular to FIGS. 1 through 8 thereof, a new infant positioning device embodying the principles and concepts of an embodiment of the disclosure and generally designated by the reference numeral 10 will be described.

As best illustrated in FIGS. 1 through 8, the infant positioning kit assembly 10 generally comprises a mattress cover 12 that has a top wall 14, a bottom wall 16 and a perimeter wall 18 that is attached to and extends between the top 14 and bottom 16 walls. The perimeter wall 18 includes a front wall 20, a back wall 22, a first lateral wall 24 and a second lateral wall 26. The bottom wall 16 has a mattress aperture 28 extending therethrough for inserting a mattress 30 into the mattress cover 12. The mattress cover 12 may be comprised of a deformable material such as cotton or other similar material. An elastic band 32 is attached to and is coextensive with a perimeter edge of the mattress aperture 28. The elastic band 32 is configured to shrink the mattress aperture 28 to secure the mattress cover 12 to the mattress 30. A pocket 34 is attached to the bottom wall 16. The pocket 34 has an open end 36 that is positioned adjacent to the front wall 20. A first mating member 38 is attached to the top wall 14.

A second mattress cover 40 may have an upper wall 42 and a peripheral wall 44 that may be attached to and extend downwardly from the upper wall 42. A sixth mating member 45 may be attached to an entire top surface 46 of the upper wall 44. The second mattress cover 40 may be configured to wrap around a smaller mattress that may be found on changing tables, neo-natal cribs, or other similar mattresses. The second mattress cover 40 may be comprised of a deformable material such as a foamed elastomer, cotton, or other similar deformable material.

An attachment member 48 is configured to be worn by an infant 50. Generally, a second mating member 56 is attached to the attachment member 48. The second mating member 56 may be positioned on a surface of the attachment member 48 opposite of a surface that abuts the infant 50. The second mating member 56 is releasably attachable to the first mating member 38 to retain the infant 50 in a selected position on the mattress cover 12. The second mating member may be releasably attachable to the sixth mating member and may retain the infant 50 in a selected position on the second mattress cover 40. The first 38 and second 56 mating members may retain the infant 50 in a selectable supine position to reduce the chance of Sudden Infant Death Syndrome. The first 38 and second 56 mating members comprise hook and loop couplers.

The attachment member 48 may be a harness 52 of any conventional design or the attachment member may be a garment 54 of any conventional design. The harness 52 may include a panel 41, a first torso arm 43, a second torso arm 45 and a crotch arm 47. A third mating member 49 may be attached the first torso arm 43 and a fourth mating member 51 may be attached to the second torso arm 45. A fifth mating member 53 may be attached to the crotch arm 47. The infant 50 may be placed in the harness 52 such that the infant's 50 back may abut the panel 41. The first 43 and second 45 torso arms may be wrapped around the infant's 50 torso and the third mating member 49 may be releasably engaged with the fourth mating member 51. The crotch arm 47 may be extended through the infant's 50 crotch and extended upwardly on the infant's 50 body so the fifth mating member 53 may also releasably engage the fourth mating member 51. The third 49, fourth 51 and fifth 53 mating members may comprise hook and loop fasteners.

A wedge 58 is provided that has an upper surface 60, a lower surface 62, a rear surface 64, a front edge 66 and a pair of perimeter surfaces 68 each extending between the upper 60 and lower 62 surfaces. The upper 60 and lower 62 surfaces taper toward each other from the rear surface 64 to the front edge 66 and the front edge 66 forms an angle 70 between 5° and 40°. The wedge 58 may be removably positioned into the pocket 34 to facilitate an elevation of the bottom wall 16. The wedge 58 may be removably positioned into the pocket 34 for relief of acid reflux symptoms in the infant 50 such that the front edge 66 extends into the pocket 34 and the upper surface 60 abuts the bottom wall 16. The wedge 58 may be comprised of a resiliently compressible material such as foamed elastomer or other similar material.

In use, the mattress cover 12 may be wrapped around a mattress 30. The infant 50 may be placed in the attaching member 48. The infant 50 may be laid upon the mattress cover 12 such that the first mating member 38 releasably engages the second mating member 56 to retain the infant 50 in a selected supine position while the infant 50 sleeps. The wedge 58 may be inserted in the pocket 34 in order to elevate an end of the mattress 30 for relief of acid reflux symptoms in the infant 50. The second mattress cover 40 may be wrapped around a smaller mattress 30, such as the mattress 30 on a changing table. The infant 50, while wearing the attaching member 48, may be laid upon the second mattress cover 40 to retain the infant in a selected position to facilitate diaper changing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An infant positioning kit assembly configured for positioning an infant in a supine position while in a crib, said assembly comprising:

a mattress cover having a top wall, a bottom wall and a perimeter wall being attached to and extending between said top and bottom walls, said perimeter wall including a front wall, a back wall, a first lateral wall and a second lateral wall, said bottom wall having a mattress aperture extending therethrough for inserting a mattress into said mattress cover, an elastic band being attached to and being coextensive with a perimeter edge of said aperture;

a pocket being attached to said bottom wall having an open end being positioned adjacent to said front wall;

a first mating member being attached to said top wall;

an attachment member configured to be worn by an infant, said attachment member comprising a garment for completely covering an infant's torso;

a second mating member being attached to said attachment member, said second mating member being releasably attachable to said first mating member to retain an infant in a selected position on said mattress cover, said first and second mating members comprising hook and loop couplers, a first one and a second one of said second mating member being attached in spaced relationship to opposite sides of said garment, each of said first and second ones of said second mating member being elongated extending from a waist region toward a shoulder region of said garment wherein said waist region is configured to cover an infant's waist and said shoulder region is configured to cover the infant's shoulders when said garment is worn by the infant, a top end of each of said first and second ones of said second mating member being positioned between arm openings of said garment proximate said shoulder region; and a wedge having an upper surface, a lower surface, a rear surface, a front edge and a pair of perimeter surfaces each extending between said upper and lower surfaces, said wedge being positionable into said pocket to facilitate an elevation of said rear surface, said wedge being solid between said upper surface and said lower surface, between said front edge and said rear surface, and between each of said perimeter surfaces.

2. The assembly as in claim 1, further comprising said upper and lower surfaces tapering toward each other from said rear surface to said front edge and said front edge forming an angle between 5° and 40°, said wedge being comprised of a resiliently compressible material.

3. An infant positioning kit assembly configured for positioning an infant in a supine position while in a crib, said assembly comprising:

a mattress cover having a top wall, a bottom wall and a perimeter wall being attached to and extending between said top and bottom walls, said perimeter wall including a front wall, a back wall, a first lateral wall and a second lateral wall, said bottom wall having a mattress aperture extending therethrough for inserting a mattress into said mattress cover, an elastic band being attached to and being coextensive with a perimeter edge of said aperture;

a pocket being attached to said bottom wall having an open end being positioned adjacent to said front wall;

a first mating member being attached to said top wall;

an attachment member configured to be worn by an infant, said attachment member comprising a garment for completely covering an infant's torso;

a second mating member being attached to said attachment member, said second mating member being releasably attachable to said first mating member to retain an infant in a selected position on said mattress cover, said first and second mating members comprising hook and loop couplers, a first one and a second one of said second mating member being attached in spaced relationship to opposite sides of said garment, each of said first and second ones of said second mating member being elongated extending from a waist region toward a shoulder region of said garment wherein said waist region is configured to cover an infant's waist and said shoulder region is configured to cover the infant's shoulders when said garment is worn by the infant, a top end of each of said first and second ones of said second mating member being positioned between arm openings of said garment proximate said shoulder region; and a wedge having an upper surface, a lower surface, a rear surface, a front edge and a pair of perimeter surfaces each extending between said upper and lower surfaces, said upper and lower surfaces tapering toward each other from said rear surface to said front edge and said front edge forming an angle between 5° and 40°, said wedge being removably positionable into said pocket to facilitate an elevation of said bottom wall, said wedge being comprised of a resiliently compressible material, said wedge being solid between said upper surface and said lower surface, between said front edge and said rear surface, and between each of said perimeter surfaces.

* * * * *